US005942844A

United States Patent [19]

Nakamura et al.

[11] Patent Number: 5,942,844

[45] Date of Patent: Aug. 24, 1999

[54] COLOR CATHODE RAY TUBE HAVING A SMALL NECK DIAMETER

[75] Inventors: Tomoki Nakamura; Shoji Shirai; Go Uchida; Shinichi Kato, all of Mobara; Kenichi Watanabe, Isumi-gun; Mamoru Tsuzurahara, Mobara, all of Japan

[73] Assignee: Hitachi, Ltd., Tokyo, Japan

[21] Appl. No.: 08/949,436

[22] Filed: Oct. 14, 1997

[30] Foreign Application Priority Data

Oct. 14, 1996 [JP] Japan ..... 8-270944

[51] Int. Cl.[6] ..... H01J 29/51; H01J 29/62

[52] U.S. Cl. ..... 313/414; 313/412; 313/460

[58] Field of Search ..... 313/414, 412, 313/415, 425, 428, 432, 439, 449, 458, 460; 315/382, 382.1, 14, 15, 368.15

[56] References Cited

U.S. PATENT DOCUMENTS

| | | | |
|---|---|---|---|
| 4,581,560 | 4/1986 | Shirai et al. | 313/414 |
| 4,851,741 | 7/1989 | Shirai et al. | 313/414 X |
| 5,025,189 | 6/1991 | Son | 313/414 |
| 5,142,189 | 8/1992 | Sugawara et al. | 313/414 |
| 5,212,423 | 5/1993 | Noguchi et al. | 313/414 |
| 5,281,896 | 1/1994 | Bae et al. | 313/414 |
| 5,300,855 | 4/1994 | Kweon | 313/414 |
| 5,488,265 | 1/1996 | Chen | 313/414 |

*Primary Examiner*—Ashok Patel
*Attorney, Agent, or Firm*—Antonelli, Terry, Stout & Kraus, LLP

[57] ABSTRACT

A color cathode ray tube has a phosphor screen and an in-line electron gun. Each of the focus electrode and the anode of has a single opening for passing three electron beams. The single opening has a diameter larger in a horizontal direction than a diameter thereof in a vertical direction. Each of the focus electrode and the anode has a plate electrode placed therein and forming apertures for passing the three electron beams respectively. The focus electrode and the anode forms a main lens therebetween. The distance from the main lens to the phosphor screen is 360 mm or less, the outside diameter T in mm of the neck portion of the evacuated envelope housing the electron gun satisfies 23.5 mm≦T≦25.3 mm, the value D in mm of twice the distance from the center of a trajectory of a side electron beam to a vertical edge of the single opening in each of the focus electrode and the anode satisfies 6.5 mm<D≦8.3 mm, and the center-to-center spacing S in mm between two adjacent electron beams satisfies T-15.5 mm≧2S.

3 Claims, 7 Drawing Sheets

COLOR CATHODE RAY TUBE HAVING A SMALL NECK DIAMETER

BACKGROUND OF THE INVENTION

The present invention relates to a color cathode ray tube, and particularly to a color cathode ray tube employing an in-line type electron gun configured to project three electron beams in a line toward a phosphor screen.

Color cathode ray tubes are widely used as display devices for television receivers and terminal monitors of information equipment represented by personal computers.

FIG. 4 is a sectional view illustrating a configuration example of a color cathode ray tube to which the present invention is applied. Reference numeral 20 indicates a panel portion for forming a screen; 21 is a neck portion; 22 is a funnel portion; 23 is a phosphor screen; 24 is a shadow mask; 25 is a mask frame; 26 is a magnetic shield; 27 is a shadow mask suspension mechanism; 28 is an in-line type electron gun; 29 is a deflection device; 30 is a magnetic correction device for beam centering and color purity adjustment; 31 is a getter; 32 is an internal conductive layer; 33 is a tension band; 34 is stem pins for supplying a video signal and various voltages to the electron gun; 35 is an anode button; and 36 is a contact spring for supplying a high anode electrode voltage to the electron gun.

In the color cathode ray tube of this type, an evacuated envelope is composed of the panel portion 20, the neck portion 21, and the funnel portion 22 connecting the panel portion 20 to the neck portion 21, and a portion connecting the panel portion 20 and the funnel portion 22 is tightly wound by the tension band 33 for implosion protection.

The phosphor screen 23 coated with phosphors of three colors, red, green, and blue in a stripe pattern or a dot pattern is formed on the inner surface of the panel portion 20, to form a viewing screen.

The in-line type electron gun 28 for projecting three electron beams in a line in a horizontal plane is housed in the neck portion 21. The shadow mask 24 having a multi-apertured thin plate or parallel wires and serving as a color selection electrode is fixed to the mask frame 25 and is suspended from the inner wall of the panel portion 20 by the shadow mask suspension mechanism 27 at a position close to the phosphor screen 23 formed on the inner surface of the panel portion 20.

Characters Bc and Bs×2 indicate three electron beams. The deflection device 29 for deflecting the electron beams in the horizontal and vertical directions to scan the electron beams two-dimensionally on the phosphor screen is mounted in a transition region between the funnel portion 22 and the neck portion 21.

An anode voltage is applied from the anode button 35 formed in the funnel portion 22 to the electron gun 28 by way of an internal conductive coating 32 and the contact spring 36. Three electron beams, one center beam Bc and two side beams Bs, projected from the electron gun 28 in a line are deflected in the horizontal and vertical directions through horizontal and vertical deflection magnetic fields generated by the deflection yoke 29, being subjected to color selection by the shadow mask 24, and impinge upon respective phosphors forming the phosphor screen 23, to thus form a color image on the panel portion 20.

The magnetic correction device 30 is mounted around the neck portion 21 for centering adjustment for landing three electron beams on the center of the screen and color purity adjustment for landing three electron beams on respective proper phosphors.

The in-line type electron gun housed in neck portion 21, although it may be of any one of known various types, generally includes a triode section having three cathodes, a first grid electrode, and a second grid electrode; a focus electrode for accelerating and focusing electron beams; and an anode forming a main lens in cooperation with the focus electrode.

On example of such an in-line type electron gun is disclosed in Japanese Patent Laid-open No. Sho 58-103752.

FIG. 5 is a schematic sectional view illustrating a configuration of the in-line type electron gun disclosed in the above document.

FIGS. 6A and 6B are schematic sectional views showing essential portions of the electron gun shown in FIG. 5, FIG. 6A is the sectional view taken on line VIA—VIA, and FIG. 6B is the sectional view taken on line VIB—VIB.

In FIG. 5, reference numerals 2R, 2G and 2B indicate cathodes for red, green and blue beams, respectively; 3 is a first grid electrode as serving a control grid; 4 is a second grid electrode serving as an accelerating electrode. In FIG. 5 and FIGS. 6A and 6B, reference numeral 5 indicates a third electrode serving as a focus electrode; 5*a* is a single opening in a fifth electrode; 6 is a plate electrode provided within the focus electrode; 7 is an anode; 7*a* is a single opening in the anode; and 8 is a plate electrode provided within the anode electrode.

Each of the focus electrode 5 and the anode electrode 6 has a transverse cross-section of an approximately ellipse with its major axis in the in-line direction or a horizontally elongated rectangle with its corners rounded, has a single opening allowing three electron beams to pass therethrough at least at its end face facing the end face of the other (a main lens-forming end face).

As shown in FIG. 6A, the plate electrode 6 disposed in the focus electrode 5 has an elliptical center beam aperture with its major axis vertical and two side beam apertures having a pair of oppositely disposed semi-circles or semi-ellipses of same or different radii. As shown in FIG. 6B, the plate electrode 8 disposed in the anode 7 has an elliptical center beam aperture with its major axis vertical and two semi-elliptical cutouts formed on both the sides of the center beam aperture.

The operation of the in-line type electron gun having the above configuration will be described.

Thermoelectrons emitted from the three cathodes 2R, 2G and 2B heated by heaters (not shown) are attracted toward the first grid electrode (or control grid) 3 by a positive voltage of 400 to 1000 V applied to the second grid electrode (or acceleration electrode) 4, to form three electron beams Bs, Bc and Bs.

The three electron beams Bs, Bc and Bs pass through an aperture in the first grid electrode (control grid) 3 and then through an aperture in the second grid electrode (accelerating electrode) 4, are accelerated by positive voltages applied to the third electrode (focus electrode) 5 and the anode electrode 7 and enter the main lens.

Here, before entering the main lens, the electron beams are slightly focused by a prefocus lens formed between the accelerating electrode 4 and the focus electrode 5 supplied with a low voltage of about 5 to 10 kV.

A high voltage of about 20 to 35 kV is applied to the anode 7 constituting the main lens. The electron beams are focused on the phosphor screen by the main lens formed by a potential difference between the focus electrode 5 and the anode electrode 7, to form beam spots on the screen.

In a high definition color cathode ray tube employing a prior art in-line electron gun having the above configuration, particularly used for an information terminal such as a computer, if a conventional value of 29.1 mm is adopted for the outside diameter of a neck portion, a deflection power consumption in a deflection device increases with increase in deflection frequency due to the number of scanning lines increased for a high definition display, and therefore the neck portion is desired smaller.

The reduction in the outside diameter of the neck portion, however, presents a problem in that the main lens diameter of the electron gun is reduced, to increase the beam spot diameter on the phosphor screen, thereby degrading the resolution.

To solve the above problem, there is proposed a technique, for example, in Japanese Patent Laid-open No. Hei 5-325826. In this technique, an outside diameter T of a neck portion containing an in-line electron gun and a center-to-center spacing S between adjacent electron beams are set to satisfy a relationship of $2S+14.6\ \text{mm} \leqq T \leqq 25.3\ \text{mm}$ and $4.1\ \text{mm} \leqq S$, and a low power consumption and a small beam spot diameter are made compatible with each other.

The above-described technique, however, has the following disadvantage. When a low light transmittance panel (dark tainted panel) is employed for a cathode ray tube, the brightness to be produced by the phosphor needs to be increased to make up for reduction in the viewing screen brightness caused by the a low light transmittance panel. This in turn requires the beam current to be increased to raise the brightness produced by the phosphors, and an increase in the beam increases the beam spot diameter, failing to retain the focus characteristics.

SUMMARY OF THE INVENTION

An object of the present invention is to solve the above-described prior art, and to provide a color cathode ray tube employing an electron gun capable of reducing a beam spot diameter on a phosphor screen at a large beam current and consequently improving brightness by increasing a main lens diameter while maintaining deflection power consumption small.

To achieve the above object, according to an embodiment of the present invention, there is provided a color cathode ray tube including an evacuated envelope comprising a panel portion having a phosphor screen and a neck portion, and an in-line type electron gun housed in the neck portion, the in-line type electron gun including an electron beam generating section for generating and directing three in-line electron beams toward the phosphor screen, each of a focus electrode and an anode having a single opening at one end thereof for passing the three electron beams, the single opening having a diameter larger in a horizontal direction than a diameter thereof in a vertical direction, each of the focus electrode and the anode having a plate electrode placed therein and forming apertures for passing the three electron beams respectively, the focus electrode and the anode forming a main lens therebetween, wherein a distance from the main lens to the phosphor screen is 360 mm or less, an outside diameter T in mm of the neck portion housing the in-line type electron gun satisfies $23.5\ \text{mm} \leqq T \leqq 25.3\ \text{mm}$, a value D in mm of twice a distance from a center of a trajectory of a side electron beam to a vertical edge of the single opening in each of the focus electrode and the anode satisfies $6.5\ \text{mm} < D \leqq 8.3\ \text{mm}$, and a center-to-center spacing S in mm between adjacent electron beams satisfies $T-15.5\ \text{mm} \geqq 2S$.

BRIEF DESCRIPTION OF THE DRAWINGS

In the drawings, which form an integral part of the specification and are to be read in conjunction therewith, and in which like reference numerals designate similar components throughout the figures, and in which:

FIGS. 6A and 6B are schematic sectional views of the electron gun shown in FIG. 5, wherein FIG. 6A is the sectional view taken along line VIA—VIA, and FIG. 6B is the sectional view taken along line VIB—VIB.

DETAILED DESCRIPTION OF THE PREFERRED EMBODIMENTS

An efficacious reduction in power consumption of a color cathode ray tube can be achieved by reducing a diameter T of a glass tube of a neck portion to 25.3 mm or less as proposed in the above-mentioned Japanese Patent Laid-open No. Hei 5-325826.

$$T \leqq 25.3\ \text{mm} \tag{1}$$

Figure 7:
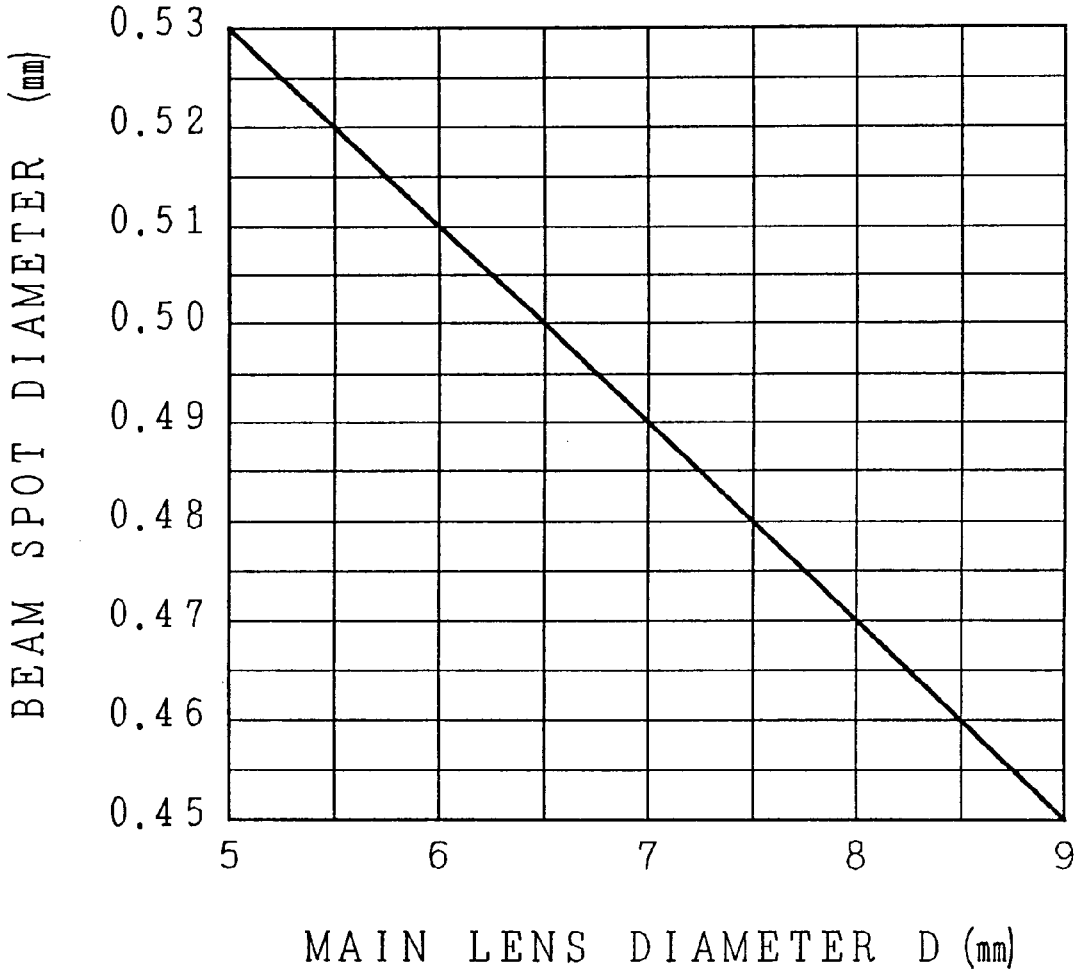
FIG. 7 is a diagram showing an experimentally obtained relationship between an effective diameter D of a main lens of a color cathode ray tube and the minimum beam spot diameter obtainable by the main lens.

FIG. 7 is a diagram showing an experimentally obtained relationship between an effective diameter D of a main lens of a 90° -deflection color cathode ray tube having a 41-cm effective diagonal screen size and the minimum beam spot diameter obtainable by the main lens. In this figure, the abscissa indicates the main lens diameter D (mm) and the ordinate indicates the beam spot diameter (mm) on the phosphor screen.

The analyzing conditions for data of FIG. 7 are: an electron beam current Ik=300 $\mu$A, and an anode voltage=26 kV. Cathode ray tubes employing a low light transmittance panel having transmittance not higher than 50% (preferable transmittance is in a range of between 38% and 50%) are generally operated under these conditions.

Figure 5:
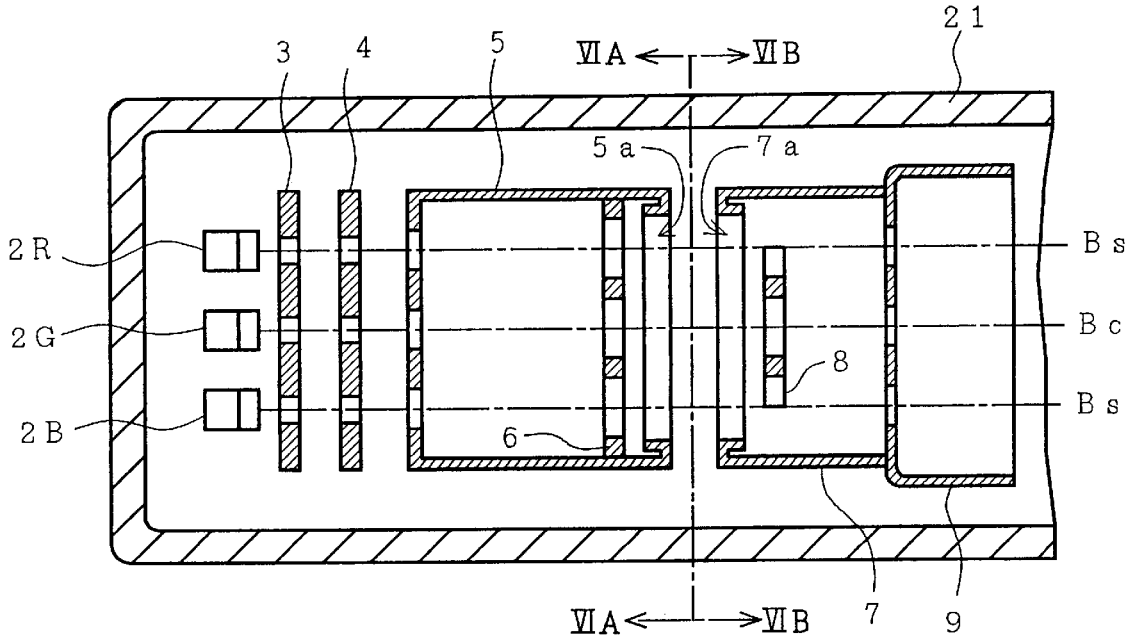
FIG. 5 (PRIOR ART)
FIG. 5 is a schematic sectional view illustrating a configuration of a prior art in-line type electron gun.
Figure 6A:
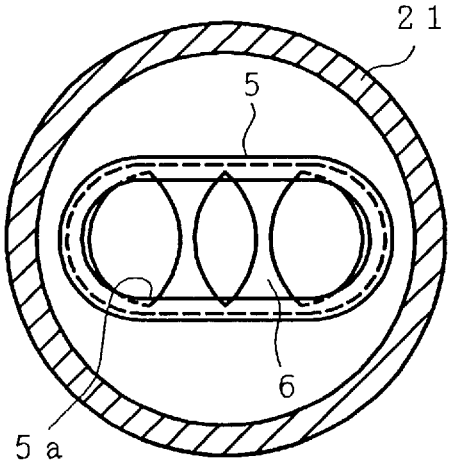
FIG. 6A (PRIOR ART)
Figure 6B:
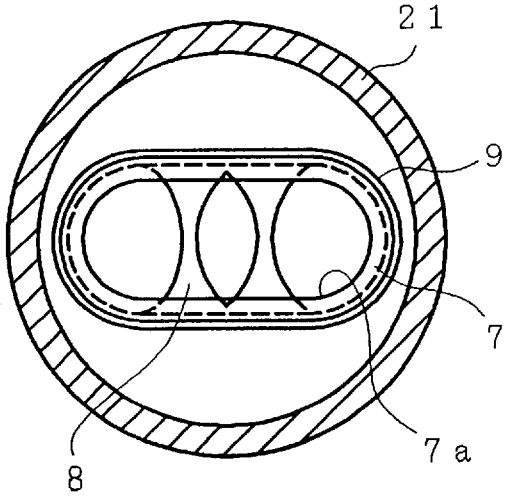
FIG. 6B (PRIOR ART)

The main lens is of the bi-potential type lens shown in FIG. 5, and the focus electrode voltage is set to be 33% or less of the anode voltage. The characteristic shown in FIG. 7 also apply substantially to a multi-stage focus type lens shown in FIG. 3 (which will be described later) if the ratio of the focus electrode voltage to the anode voltage is the same as above.

Further, in the color cathode ray tube of this size in general, a distance from the main lens to the phosphor screen is about 29 mm±10 mm, and the present invention aims at optimization of an electron gun for a cathode ray tube in which the distance between the main lens and the phosphor screen is 360 mm or less.

As the main lens diameter D becomes larger, the spherical aberration of the main lens becomes smaller, and thereby the minimum beam spot diameter obtained by the main lens is made smaller.

A color cathode ray tube is required to provide good resolution on the screen, and this means that the beam spot diameter at the center of the screen needs to be 0.5 mm or less, for a cathode ray tube having an effective diagonal screen size of 41 cm, 1000 or more dots in the horizontal direction on the viewing screen and a shadow mask with an aperture pitch of less than 0.28 mm as described in "In-Line Type High-Resolution Color-Display Tube," National Technical Report, Vol. 28, No. 1 (Feb. 1982).

Figure 1:
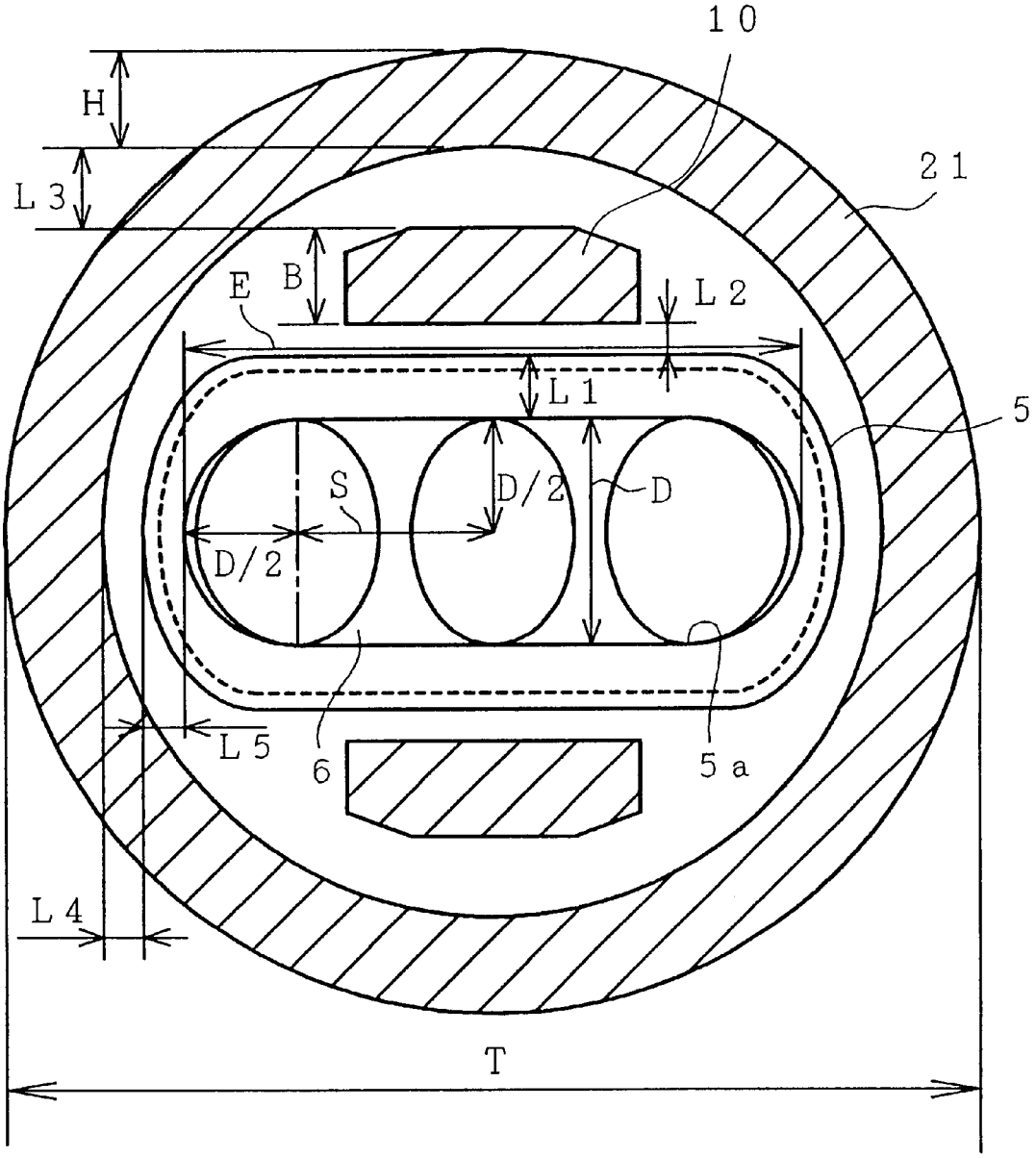
FIG. 1 is a sectional view of a neck portion containing a focus electrode having a single opening therein and constituting a main lens of an in-line electron gun, illustrating an embodiment of a color cathode ray tube of the present invention.

FIG. 1 is a sectional view of a neck portion containing an electron gun having a main lens composed of two adjacent electrodes each having an opening of a horizontal diameter larger than a vertical diameter thereof. In FIG. 1, reference numeral 5 indicates a third electrode (focus electrode); 6 is a plate electrode provided in the third electrode; 10 is insulator rods (multiform glass) for fixing the electrodes of the electron gun in position; and 21 is a glass tube of the neck portion. FIG. 1 illustrates the third electrode 5 shown in FIG. 5 and these also apply to the anode (fourth electrode) 7 similarly.

To obtain a beam spot diameter of 0.5 mm or less by using the main lens shown in FIG. 1, a value D of twice a distance from the center of a side beam trajectory to the vertical edge of the opening in the horizontal direction must be more than 6.5 mm on the basis of the data shown in FIG. 7.

$$D>6.5\text{ mm} \quad (2)$$

The tube diameter T of the neck portion in the vertical direction (perpendicular to the in-line direction of the three beams) in FIG. 1 is expressed by $$T=(D/2+L1+L2+B+L3+H)\times 2 \quad (3), \text{ and}$$

in the horizontal direction in FIG. 1 T is expressed by $$T=(S+D/2+L4+L5+H)\times 2 \quad (4)$$

where D is a value of twice a distance from the center of the trajectory of the side electron beams of the three electron beams to a vertical edge of the opening 5*a* in the horizontal direction in the electrode 5 and is substantially equal to the effective diameter of the main lens;

L1 is a rim width in the vertical direction of the electrode 5 having the opening 5*a;*

L2 is a distance from the electrode 5 to the insulator rod 10;

B is a thickness of the insulator rod 10;

L3 is a distance from the insulator rod 10 to the inner wall of the glass tube of the neck portion 21;

H is a thickness of the glass tube 21;

S is the center-to-center spacing between adjacent electron beams;

L4 is a distance from the electrode 5 to the inner wall of the glass tube 21;

L5 is a rim width in the horizontal direction of the electrode 5 having the opening 5*a*; and E is a diameter in the horizontal direction of the opening 5*a* in the electrode 5.

The rim width L1 in the vertical direction of the electrode 5 having the opening 5*a* is generally in a range of 1.0 to 1.5 mm. It is difficult and undesirable to reduce the rim width L1 to less than 1.0 mm in terms of limitations of press-forming.

The distance L2 from the electrode 5 to the insulator rod 10 is conventionally in a range of 1.0 to 1.3 mm. Since reliability against arcing must be ensured, it is difficult and undesirable to reduce the distance L2 to less than 1.0 mm.

The thickness B of the insulator rod 10 is generally in a range of 2.0 to 4.5 mm in order to avoid occurrence of cracking of the rods when electrode parts are embedded in the rods. It is difficult and undesirable to reduce the thickness B to less than 2.0 mm.

The distance L3 from the insulator rod 10 to the inner wall of the glass tube is in a range of 2.0 to 2.3 mm. Since the surface of the insulator rod 10 is not curved and reliability against arcing must be ensured, it is difficult and undesirable to reduce the distance L3 to less than 2.0 mm.

The glass thickness H of the glass tube in the prior art color cathode ray tube is in a range of 2.5 to 2.8 mm. It is difficult and undesirable to reduce the glass thickness H to less than 2.5 mm in terms of physical strength of the glass tube.

When the above numerical values are substituted, to make the value D larger than 6.5 mm in the equation (3), the glass tube diameter T of the neck portion must satisfy the following relationship:

$$T\geqq 23.5\text{ mm} \quad (5)$$

Accordingly, from the equations (1) and (5), is given the following relationship:

$$23.5\text{ mm}\leqq T\leqq 25.3\text{ mm}$$

Further, to simultaneously satisfy the equations (3) and (1), the value D must satisfy the following relationship:

$$D\leqq 8.3\text{ mm}$$

As a result, the following relationship of value D is given:

$$6.5\text{ mm}<D\leqq 8.3\text{ mm}$$

Besides, the rim width L5 in the horizontal direction of the electrode 5 having the opening 5*a* is generally in a range of 1.0 to 1.5 mm. It is difficult and undesirable to reduce the rim width L5 to less than 1.0 mm in terms of limitations of press-forming.

The distance L4 from the electrode 5 to the inner wall of the glass tube 21 in the electron gun of the prior art color cathode ray tube is in a range of 1.0 to 1.3 mm. It is difficult and undesirable to reduce the distance L4 to less than 1.0 mm in terms of ensuring reliability against arcing.

Accordingly, from the equations (2) and (4), a relationship between T and S is given by $$T-15.5\text{ mm}\geqq 2S$$

With the above configuration, there can be provided a color cathode ray tube including an electron gun capable of reducing a beam spot diameter on a phosphor screen at a large beam current and consequently improving brightness, by increasing a main lens diameter while maintaining deflection power consumption small.

Hereinafter, the present invention will be described in detail by example of an embodiment.

FIG. 1 is a sectional view of a neck portion containing a focus electrode having a single opening common to three electron beams and constituting a main lens in an in-line type electron gun, illustrating one embodiment of a color cathode ray tube in which the present invention is applied to the bi-potential type main lens as shown in FIG. 5.

When the following numerical values for FIG. 1 are substituted, the center-to-center spacing S between the adjacent electron beams in a triode section of an electron gun=4.0 mm;

the value D of twice the distance from the center of the side electron beam trajectory to the vertical edge in the horizontal direction of the opening 5*a*=7.0 mm;

the rim width L5 in the horizontal direction adjacent the vertical edge of the opening 5*a*=1.05 mm;

the distance L4 from the electrode 5 to the inner wall of the glass tube 21=1.0 mm; and the glass thickness H of the glass tube=2.6 mm; the equation (4) becomes the glass tube diameter T=(S+D/2+L4+L5+H) ×2=(4.0+7.0/2+1.0+1.05+2.6)×2=24.3

The outside diameter T thus calculated satisfies the following relationship:

$$23.5\ \text{mm} \leqq T \leqq 25.3\ \text{mm}$$

Further, the value D, 7.0 mm, of twice the distance from the center of the side electron beam trajectory to the vertical edge in the horizontal direction of the opening 5*a* satisfies the following relationship:

$$6.5\ \text{mm} < D \leqq 8.3\ \text{mm}$$

The spacing S, 4.0 mm, between two adjacent beams satisfies the following relationship:

$$T - 15.5\ mm \geqq 2S$$

With this configuration, it is possible to reduce the beam spot diameter on the phosphor screen at a large current while maintaining the deflection power consumption small.

Figure 2:
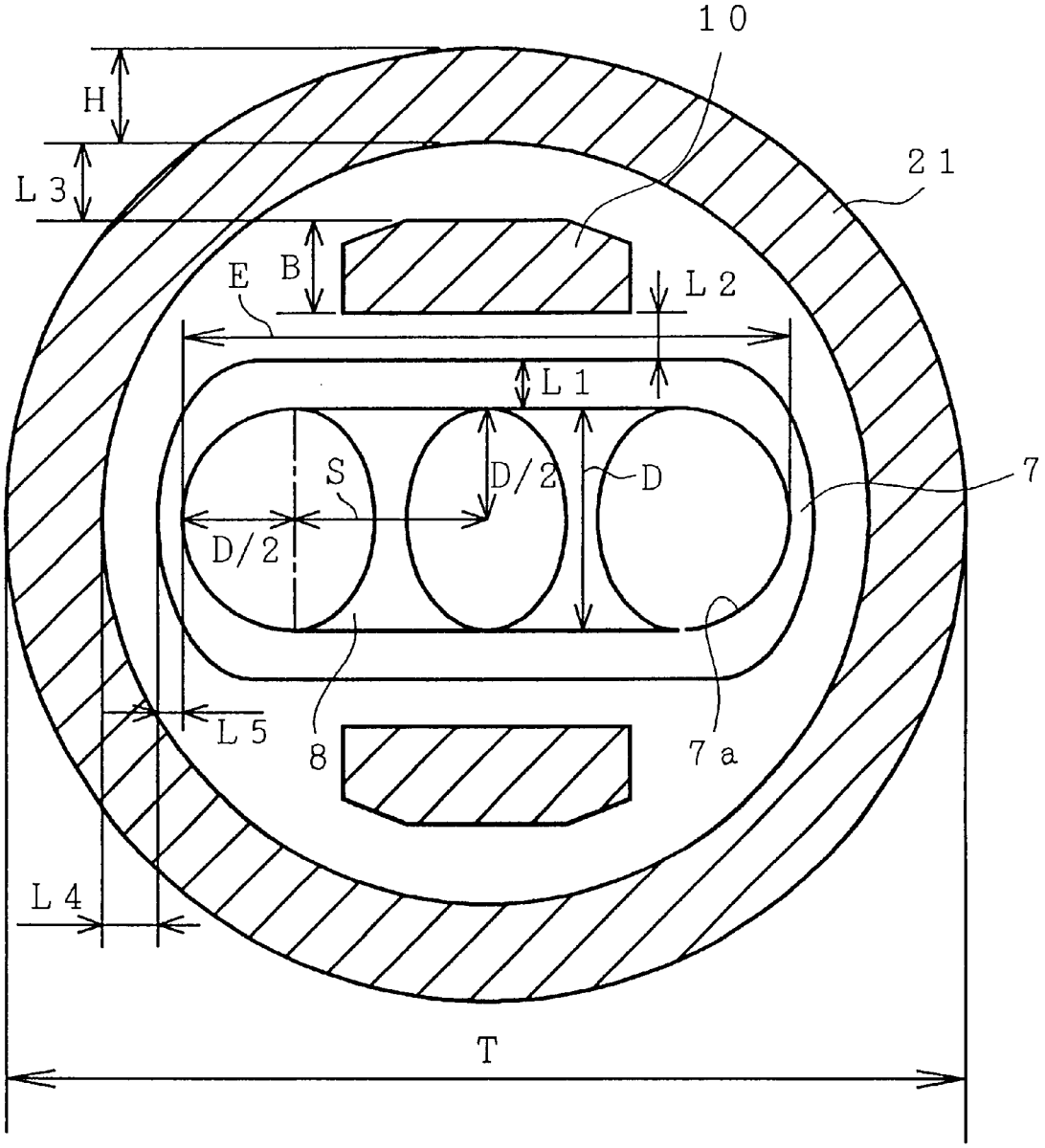
FIG. 2 is a sectional view of a neck portion containing an anode having a single opening therein and constituting the main lens of the in-line electron gun, illustrating an embodiment of the color cathode ray tube of the present invention.

FIG. 2 is a sectional view of a neck portion containing an anode having a single opening common to three electron beams and constituting a main lens in an in-line type electron gun, illustrating an embodiment of the color cathode ray tube in which the present invention is applied to the bi-potential type main lens as shown in FIG. 5. In FIG. 2, reference numeral 7 indicates an anode; 7*a* is a single opening common to three electron beams; 8 is a plate electrode; and 9 is a shield cup. In FIG. 2, the same characters as those in FIG. 1 correspond to the same parts as in FIG. 1.

When the following numerical values for FIG. 2 are substituted, the center-to-center spacing S between the adjacent electron beams in a triode section of an electron gun=4.0 mm;

the value D of twice the distance from the center of the side electron beam trajectory to the vertical edge in the horizontal direction of the opening 7*a*=7.0 mm;

the rim width L5 in the horizontal direction adjacent the vertical edge of the opening 7*a*=1.05 mm;

the distance L4 from the anode 7 to the inner wall of the glass tube of the neck portion 21=1.0 mm; and the glass thickness H of the glass tube=2.6 mm; the equation (4) becomes the glass tube diameter T=(S+D/2+L4+L5+H) ×2=(4.0+7.0/2+1.0+1.05+2.6)×2=24.3

The glass tube diameter T satisfies the following relationship:

$$23.5\ \text{mm} \leqq T \leqq 25.3\ \text{mm}$$

Further, the value D, 7.0 mm, of twice the distance from the center of the side electron beam trajectory to the vertical edge in the horizontal direction of the opening 7*a* satisfies the following relationship:

$$6.5\ \text{mm} < D \leqq 8.3\ \text{mm}$$

The spacing S, 4.0 mm, between two adjacent beams satisfies the following relationship:

$$T - 15.5\ mm \geqq 2S$$

By forming a main lens between the opposing end faces of the focus electrode 5 and the anode 7 configured as explained above, it is possible to reduce a beam spot diameter on a phosphor screen at a large current while maintaining deflection power consumption small.

Figure 3:
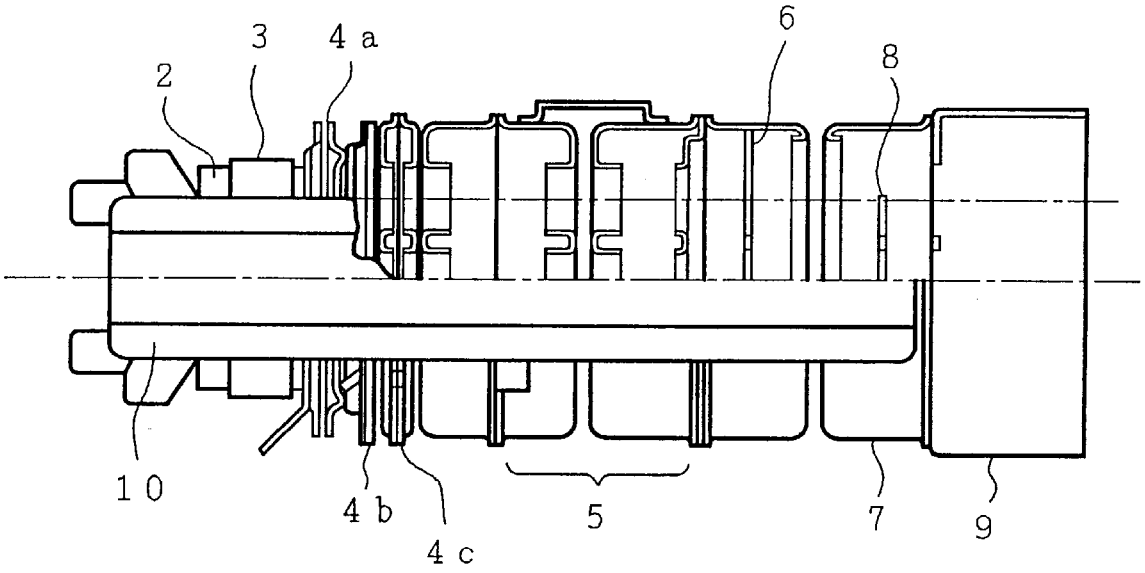
FIG. 3 is a partial sectional view illustrating a structure of another type of an electron gun used for the color cathode ray tube of the present invention.
Figure 4:
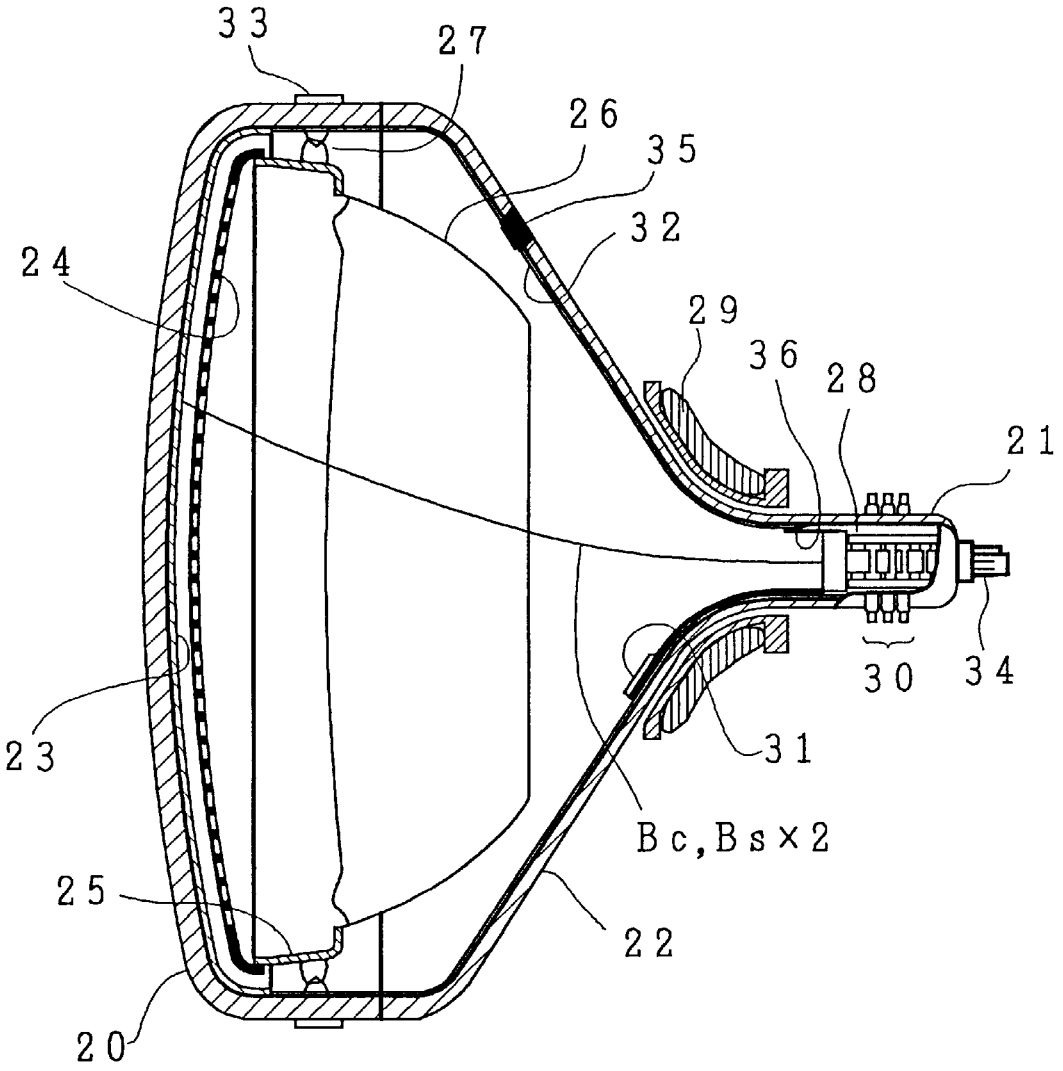
FIG. 4 is a sectional view illustrating a configuration example of the color cathode ray tube to which the present invention is applied.

FIG. 3 is a partial sectional view illustrating a structure of a multi-stage focus type electron gun used for the color cathode ray tube of the present invention. The electron gun shown in FIG. 3 has a plurality of focus electrodes while the electron gun shown in FIG. 5 has a single focus electrode.

In the electron gun shown in FIG. 3, a cup-shaped first grid electrode 3 containing three cathode electrodes 2 (2R, 2G, 2B) therein, a second grid electrode 4*a*, a third electrode 4*b*, a fourth electrode 4*c*, a fifth electrode 5 composed of a first sub-electrode upstream and a second sub-electrode downstream internally connected, an anode 7, and a shield cup 9 are fixed on insulator rods 10.

The plate electrodes 6 and 8 shown in FIGS. 1 and 2 are disposed in the second sub-electrode of the fifth electrode 5 and the anode 7, respectively.

The configuration of each of the fifth electrode 5 and the anode 7 has the same dimensional relationship as that described with reference to FIGS. 1 and 2.

A focus voltage is applied to the third electrode 4*b* and the fifth electrode 51*a*. The same positive voltage as that applied to the second grid electrode 4*a* serving as the accelerating electrode is applied to the fourth electrode 4*c*. The third electrode 4*b*, the fourth electrode 4*c*, the fifth electrode 5, and the anode 7 constitute a main lens acting as a multi-stage focus lens. For the same ratio of a focus electrode voltage to an anode voltage, the beam spot characteristics of the multi-stage focus type lens are substantially equal to those of the bi-potential type lens, and therefore, the characteristic shown in FIG. 7 can apply to an electron gun employing the multi-stage focus type lens. As in the case of the bi-potential type electron gun to which the present invention is applied, the electron gun employing the multi-stage focus type lens makes it possible to reduce the deflection power consumption and make smaller the beam spot diameter on the phosphor screen at a large beam current.

The present invention is not limited to the above-described electron guns, but can be similarly applied to other known types of electron guns.

Although the description has been made by example of a 90° deflection color cathode ray tube having a 41-cm. effective diagonal screen size in the embodiments, the present invention is not limit ed thereto. For example, by an experiment in which the present invention was applied to a high definition cathode ray tube having a 46-cm effective diagonal screen size, it was confirmed that a beam spot diameter of 0.5 mm or less can obtained for a beam current of 300 $\mu$A and 2 millions of pixels can be resolved. Further, the present invention can be applied to a 100° deflection high definition cathode ray tube.

As described above, according to the present invention, there is provided a color cathode ray tube including an evacuated envelope at least including a panel portion on which a phosphor screen is formed, a neck portion, and a funnel portion connecting the panel portion to the neck portion and an in-line type electron gun housed in the neck portion. The electron gun includes an electron beam generating section composed of cathodes, a control electrode and an accelerating electrode for generating three electron beams substantially in parallel in a horizontal plane toward the phosphor screen; a focus electrode having a single opening therein of a diameter in a direction parallel to the horizontal plane larger than a diameter thereof in a direction perpendicular to the horizontal plane for passing the three electron beams therethrough and a plate electrode within the focus electrode having three electron beam apertures therein for passing the three electron beams therethrough individually; and an anode electrode disposed opposing the focus electrode for forming a main lens by the opposing faces thereof, the anode having a single opening therein of a diameter in a direction parallel to the horizontal plane larger than a diameter thereof in a direction perpendicular to the horizontal plane for passing the three electron beams and a plate electrode within the anode having three electron beam apertures therein for passing the three electron beams therethrough individually, Also, in a color cathode ray tube having the main lens disposed within a distance of not more than 360 mm from the phosphor screen, it becomes possible to reduce a beam spot diameter on the phosphor screen at a large current while maintaining power consumption of a deflection device small, and hence to display high resolution images over the entire current region even when a so-called dark tainted panel (light transmittance: 50% or less) is employed.

What is claimed is:

1. A color cathode ray tube comprising at least an evacuated envelope comprising a panel portion having a phosphor screen formed on an inner surface thereof, a neck portion, and a funnel portion connecting said panel portion and said neck portion and an in-line type electron gun housed in said neck portion, said in-line type electron gun including an electron beam generating section comprising at least a cathode, a control electrode and an accelerating electrode for generating and directing three electron beams substantially in parallel in a horizontal plane toward said phosphor screen, a focus electrode having a single opening at one end thereof for passing said three electron beams, said single opening having a diameter larger in a direction parallel to said horizontal plane than a diameter thereof in a direction perpendicular to said horizontal plane, said focus electrode having a plate electrode placed therein and forming apertures for passing said three electron beams respectively, an anode facing said one end of said focus electrode and having a single opening at one end thereof for passing said three electron beams, said single opening having a diameter larger in a direction parallel to said horizontal plane than a diameter thereof in a direction perpendicular to said horizontal plane, said anode having a plate electrode placed therein and forming apertures for passing said three electron beams respectively, said focus electrode and said anode forming a main lens therebetween, wherein a distance from said main lens to said phosphor screen is 360 mm or less;

an outside diameter T in mm of said neck portion housing said in-line type electron gun satisfies a relationship of $23.5\ \text{mm} \leqq T \leqq 25.3\ \text{mm}$;

a value D in mm of twice a distance from a center of a trajectory of a side electron beam of said three electron beams to a vertical edge in a horizontal direction of said single opening in each of said focus electrode and said anode satisfies a relationship of $6.5\ \text{mm} < D \leqq 8.3\ \text{mm}$; and a center-to-center spacing S in mm between adjacent electron beams of said three electron beams satisfies a relationship of $T - 15.5\ \text{mm} \geqq 2S$.

2. A color cathode ray tube according to claim 1, wherein a light transmittance of said panel portion is 50% or less.

3. A color cathode ray tube according to claim 2, wherein said light transmittance of said panel portion is in a range of between 38% and 50%.

* * * * *